US005364671A

United States Patent [19]

Gustafson

[11] Patent Number: 5,364,671

[45] **Date of Patent: * Nov. 15, 1994**

[54] COVER ASSEMBLY FOR USE WITH PHOTOGRAPHS

[75] Inventor: Donald E. Gustafson, St. Paul, Minn.

[73] Assignee: Minnesota Mining and Manufacturing Company, St. Paul, Minn.

[ * ] Notice: The portion of the term of this patent subsequent to Jul. 15, 2008 has been disclaimed.

[21] Appl. No.: 729,950

[22] Filed: Jul. 15, 1991

Related U.S. Application Data

[63] Continuation-in-part of Ser. No. 419,697, Oct. 11, 1989, Pat. No. 5,032,436.

[51] Int. Cl.[5] ..... A47G 1/06

[52] U.S. Cl. ..... 428/14; 40/157; 40/158.1; 428/40; 428/45; 428/192; 428/194; 428/213; 428/220; 428/354; 428/355; 428/480; 428/913.3

[58] Field of Search ..... 428/14, 13, 45, 192, 428/194, 213, 355, 480, 220, 40, 354, 913.3; 40/158.1, 157; 283/77, 109

[56] References Cited

U.S. PATENT DOCUMENTS

| | | | |
|---|---|---|---|
| Re. 24,906 | 12/1960 | Ulrich | 428/480 |
| 2,283,026 | 5/1942 | Yates | 40/158.1 |
| 2,884,126 | 4/1959 | Ulrich | 428/480 |
| 3,024,553 | 3/1962 | Rowley | 40/158.1 |
| 3,341,961 | 9/1967 | Shanks | 40/158 |
| 3,691,140 | 9/1972 | Silver | 524/814 |
| 3,857,731 | 12/1974 | Merril | 428/319.7 |
| 3,868,293 | 2/1975 | Selph | 428/14 |
| 4,070,778 | 1/1978 | Mahler et al. | 40/124 |
| 4,079,881 | 3/1978 | Sabb | 229/92.8 |
| 4,231,833 | 11/1980 | Lieberman | 428/14 |
| 4,237,633 | 12/1980 | Murrell | 229/92.8 |
| 4,589,687 | 5/1986 | Hannon | 283/77 |
| 4,624,875 | 11/1986 | Watanabe | 428/41 |
| 4,640,030 | 2/1987 | Wood | 40/158.1 |
| 4,662,093 | 5/1987 | Suttles et al. | 428/14 |
| 4,741,119 | 5/1988 | Baryla | 40/594 |
| 4,809,451 | 3/1989 | Suzuki | 40/158.1 |
| 4,825,574 | 5/1989 | George | 40/158.1 |
| 4,864,755 | 9/1989 | Owens | 40/158.1 |
| 5,025,581 | 6/1991 | Polzin | 40/159 |
| 5,032,436 | 7/1991 | Gustafson | 428/14 |

FOREIGN PATENT DOCUMENTS

| | | | |
|---|---|---|---|
| 0257984 | 3/1988 | European Pat. Off. . | |
| 2596704 | 10/1987 | France . | |
| 1034849 | 7/1966 | United Kingdom | 428/14 |
| WOA9108915 | 6/1991 | WIPO . | |

OTHER PUBLICATIONS

International Search Report PCT/US 92/04978.

*Primary Examiner*—Ellis P. Robinson
*Assistant Examiner*—Nasser Ahmad
*Attorney, Agent, or Firm*—Gary L. Griswold; Walter N. Kirn; William L. Huebsch

[57] ABSTRACT

A cover assembly adapted for use on a photograph. The cover assembly includes a flexible conformable polymeric sheet larger than the photograph that has a central visually transparent viewing portion and an outer frame portion, the viewing portion having a size and shape adapted to afford viewing of a central portion of the photograph with edge portions of the photograph extending along the frame portion. The cover assembly has a layer of adhesive on its rear surface along the frame portion that affords firm adhesion and conformance of the sheet to the edge portions of the photograph to hold the photograph against the cover assembly, and adhesion of the sheet around the photograph to a surface to thereby support the photograph and cover assembly along the surface, while being removable from the surface and portion of the photograph without damage thereto.

14 Claims, 2 Drawing Sheets

COVER ASSEMBLY FOR USE WITH PHOTOGRAPHS

RELATED APPLICATION

This application is a continuation in part of U.S. patent application Ser. No. 07/419,697 filed Oct. 11, 1989, which issued on Jul. 16, 1991, as U.S. Pat. No. 5,032,436.

TECHNICAL FIELD

The present invention relates to inexpensive cover assemblies of polymeric materials for use with photographs.

DISCLOSURE OF THE INVENTION

The present invention provides a cover assembly for a photograph that is simple to manufacture, affords displaying the photograph over an extended period of time without separating therefrom, and can subsequently be removed from the photograph without damage to the photograph or to surfaces to which the cover assembly attaches the photograph.

According to the present invention there is provided a cover assembly adapted for use on a photograph of a predetermined size or range of sizes. The cover assembly comprises a flexible conformable polymeric sheet having a thickness of up to about 0.2 millimeter (0.008 inch), a peripheral edge between its major front and rear surfaces having length and width dimensions exceeding the length and width dimensions of the photograph by at least about 6 millimeters (0.25 inch), a generally centrally located viewing portion that is visually transparent between the surfaces, and a frame portion around the viewing portion. The viewing portion of the sheet has a size and shape adapted to afford viewing of a central portion of the photograph with edge portions of the photograph extending along its frame portion. The cover assembly has a layer of adhesive on its rear surface along the frame portion while the viewing portion of sheet is free of adhesive. The adhesive affords firm adhesion and conformance of the sheet to the edge portions of the photograph to hold the photograph against the cover assembly, and adhesion of the sheet around the photograph to a surface to thereby support the photograph and cover assembly along the surface, while being removable from the surface and portion of the photograph without damage thereto.

In a preferred embodiment of the cover assembly the adhesive is a mixture of a permanent isooctyl acrylate/acrylic acid copolymer pressure sensitive adhesive and a repositionable pressure sensitive adhesive comprising inherently tacky elastomeric acrylate microspheres which are solid in nature, comprises from 5 to 20 percent and preferably 15 percent of the permanent pressure sensitive adhesive and from 95 to 80 percent and preferably 85 percent of the repositionable pressure sensitive adhesive, and is applied in a layer weighing in the range of 8.37 to 16.75 grams and preferably 12.56 grams per square meter (2 to 4 grains and preferably 3 grains for a square measuring 4 inches by 6 inches).

The sheet of polymeric material (e.g., polyester in the range of 0.0127 to 0.051 millimeter or 0.0005 to 0.002 inch thick and preferably 0.02 millimeter or 0.00075 inch thick) is flexible and can conform to the surface and edge of a photograph so that the adhesive can firmly adhere thereto, and the adhesive will not be peeled from the sheet by internal forces in the photograph and in the sheet that are tending to separate them.

The cover assembly can include means for making the frame portion of the sheet opaque; such as an opaque layer (e.g., of ink) printed on either or both of its front and rear surfaces, or an opaque material such as a die incorporated in the frame portion of the sheet.

The surface to which the cover assembly is adapted to attach the photograph can be the surface of a glass or polymeric sheet such as in a window, a wood panel such as on a door or desk, a painted metal panel such as that of a refrigerator, or a specially treated paper used as pages in a photo album, etc. Alternatively, the surface to which the cover assembly is adapted to attach the photograph can be the specially treated surface of a greeting card that can be provided in combination with the cover assembly and has a peripheral edge between its major front and rear surfaces having length and width dimensions about the same as or slightly greater than the length and width dimensions of the sheet, printed indicia such as a greeting on the rear surface, and a coating of release material on the front surface affording firm adhesion of the layer of adhesive on the sheet around the photograph to the front surface of the greeting card to thereby support the photograph and cover assembly along the front surface, while affording removal of the layer of adhesive from the front surface of the greeting card without damage thereto.

BRIEF DESCRIPTION OF THE DRAWING

The present invention will be further described with reference to the accompanying drawing wherein like reference numerals refer to like parts in the several views, and wherein.

DETAILED DESCRIPTION

Figure 1:
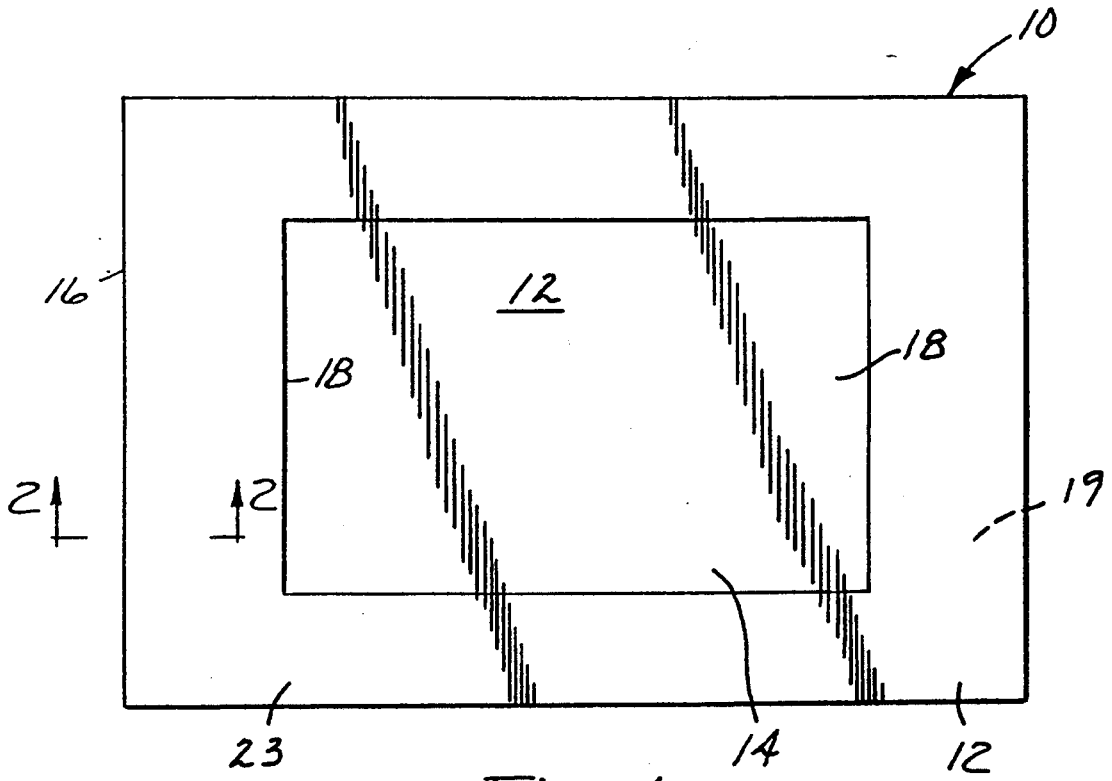
FIG. 1 is a front view of a cover assembly according to the present invention for use with a photograph.

Referring now to the drawing, there is shown a cover assembly according to the present invention generally designated by the reference numeral 10.

Figure 4:
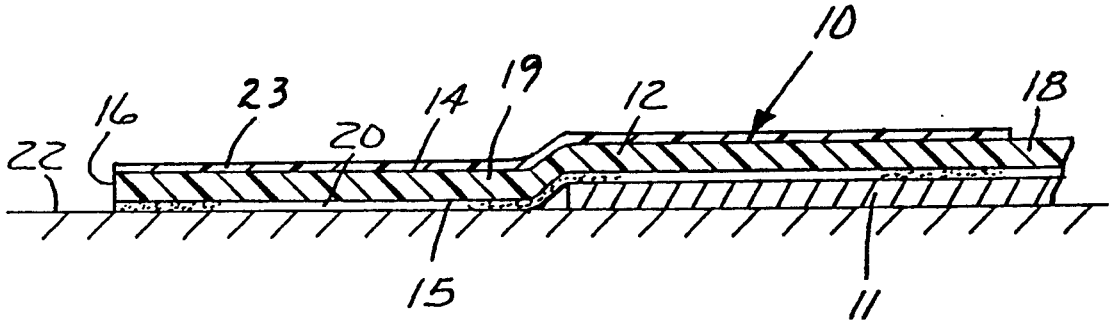
FIG. 4 is an enlarged fragmentary sectional view taken approximately along line 4—4 of FIG. 3.
Figure 3:
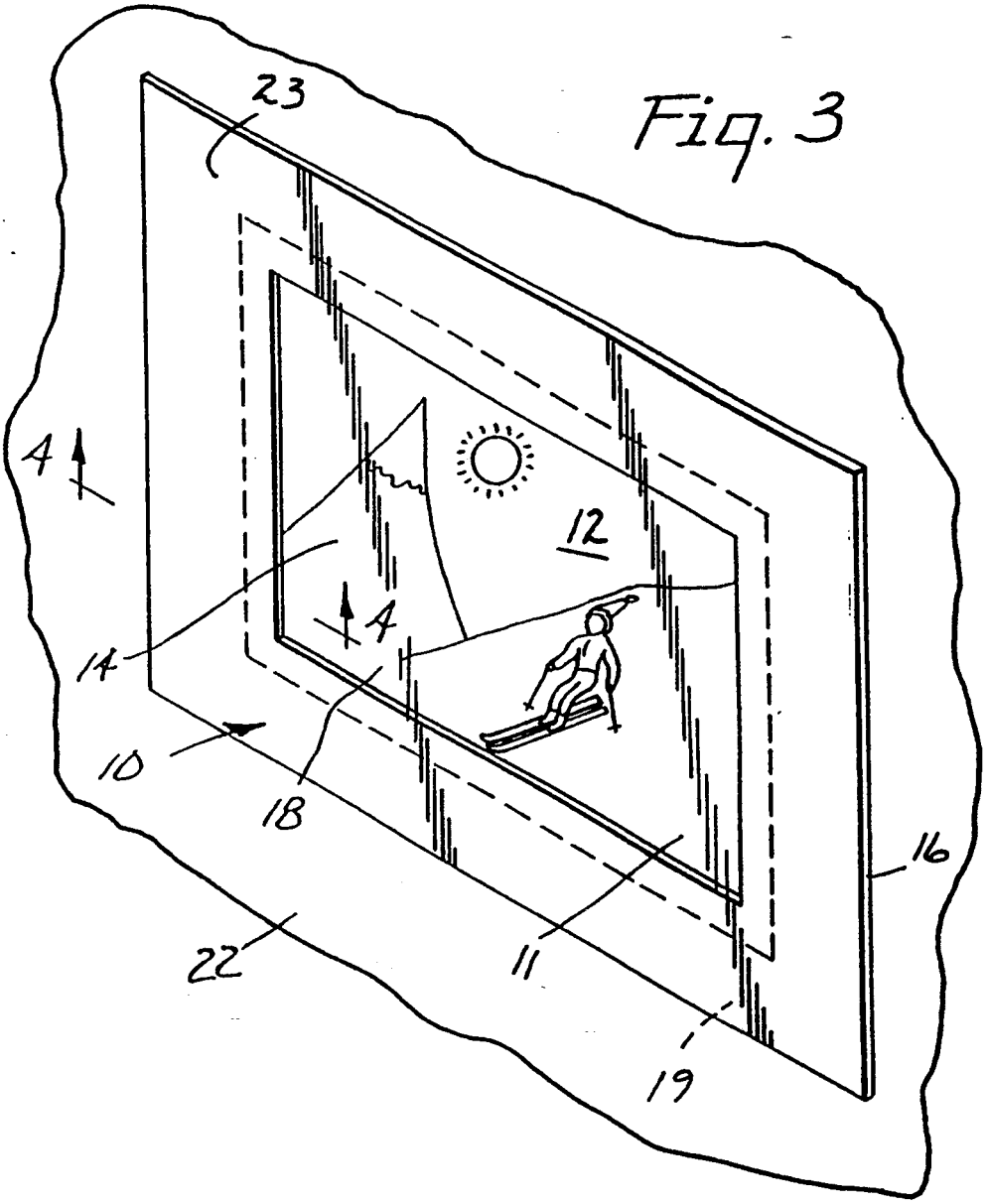
FIG. 3 is a perspective view of the cover assembly of FIG. 1 being used to attach a photograph to a surface.

Generally the cover assembly 10 is adapted for use with a photograph 11 (FIGS. 3, 4 and 5) of a single size or in a predetermined typically small range of sizes, and comprises a flexible conformable transparent polymeric sheet 12 having a thickness of up to about 0.2 millimeter (0.008 inch) such as polyester in the range of 0.0127 to 0.051 millimeter thick and preferably 0.02 millimeter or 0.00075 inch thick, opposite front and rear major surfaces 14 and 15, a peripheral edge 16 between the major surfaces 14 and 15 having length and width dimensions exceeding the length and width dimensions of the photograph 11 by at least about 6 millimeters (0.25 inch) or in the range of about 6 to 12 millimeters, a generally centrally located rectangular viewing portion 18 that is visually transparent between the surfaces 14 and 15, and a frame portion 19 around the viewing portion 18, the viewing portion 18 having a size and shape adapted to afford viewing of a central portion of the photograph 11 with edge portions of the photograph 11 around the central portion extending along the frame portion 19; and a layer 20 of adhesive along the frame portion 19 on the rear surface 15 of the sheet 12 with the viewing portion 18 being free of adhesive, the layer 20 of adhesive affording firm adhesion and conformance of the sheet 12 to the edge portions of the photograph 11 to hold the photograph 11 against the cover assembly 10 and adhesion of the sheet 12 around the photograph 11 to a smooth firm surface 22 (e.g., a surface of a glass or polymeric sheet, a wood panel, a painted metal panel, etc.) to thereby support the photograph 11 and cover assembly 10 along the surface 22 as is illustrated in FIGS. 3 and 4, while the cover assembly 10 is removable form the surface 22 and portion of the photograph 11 around the viewing portion 18 without damage to either.

The cover assembly 10 includes a layer 23 of opaque ink printed on the front surface 14 of the sheet 12 which provides means for causing at least a major part of the frame portion 19 of the sheet 12 to be opaque. The layer 23 of ink could be formed by one color or many colors to provide, for example, a decorative design or represent scenery, objects or persons, etc., or provide printed legends on a contrasting background, and the layer 23 of ink could extend onto minor parts of the viewing portion 18 of the sheet to help provide a decorative motif for the cover assembly.

The adhesive in the layer of adhesive 20 can be a mixture of a permanent isooctyl acrylate/acrylic acid copolymer pressure sensitive adhesive described in U.S. Pat. No. Re. 24,906 (the content whereof is incorporated herein by reference) and a repositionable pressure sensitive adhesive comprising inherently tacky elastomeric acrylate microspheres which are solid in nature and are prepared by aqueous suspension polymerization of alkyl acrylate monomers and ionic comonomers, which repositionable adhesive is described in U.S. Pat. No. 3,691,140 (the content whereof is incorporated herein by reference). The mixture of those adhesives should comprise from 5 to 20 percent and preferably 15 percent of the permanent pressure sensitive adhesive and from 95 to 80 percent and preferably 85 percent of the repositionable pressure sensitive adhesive. Also, preferably that adhesive mixture is applied to the rear surface 15 of the sheet 12 in a layer weighing in the range of 8.37 to 16.8 grams and preferably 12.6 grams per square meter after the rear surface 15 is primed by a suitable primer, such as the vinyl chloride polymer and zinc oxide primer commercially designated VAGH that is available from Union Carbide Corporation, Danbury, Conn. Alternatively, other adhesives that could provide the desired level of adhesion and removability with respect to photographs and the type of surfaces indicated above could be used.

Figure 2:
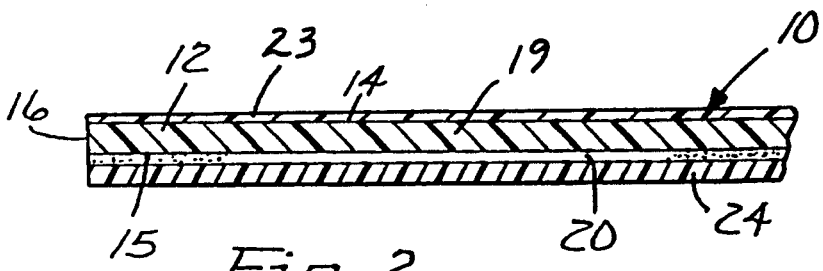
FIG. 2 is an enlarged fragmentary sectional view taken approximately along line 2—2 of FIG. 1.

The cover assembly 10 can also include a manually removable release liner 24 (FIG. 2) overlaying the side of the coating 20 of adhesive opposite the sheet 12, such as the silicone release liner commercially available from Daubert Chemical Company, Chicago, Ill. under the trade designation "2-60BKG-4000 and 4030" of which the latter two numbers refer to different coatings on the major sides of the release liner which is preferably used with the side designated "4030" against the layer 20 of adhesive.

Figure 5:
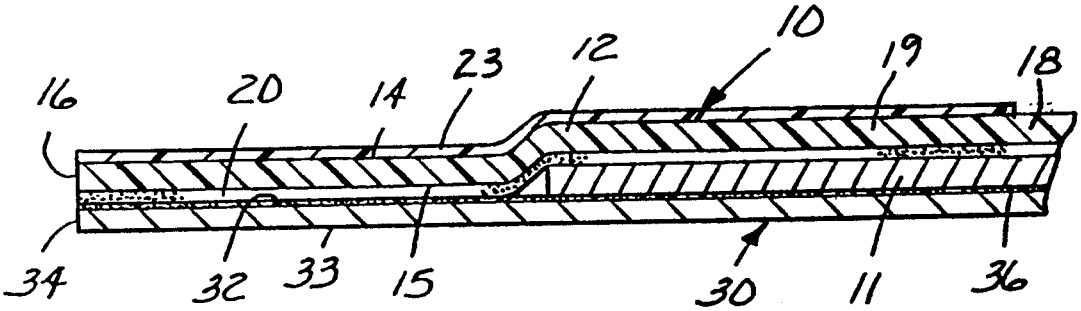
FIG. 5 is an enlarged fragmentary view of the cover assembly of FIG. 1 being used to attach a photograph to a special greeting card used in combination with the cover assembly.

As is illustrated in FIG. 5, the cover assembly 10 can also be used in combination with a paper greeting card 30 having opposite front and rear major surfaces 32 and 33, a peripheral edge 34 between the major surfaces 32 and 33 having length and width dimensions about the same as or slightly larger than the length and width dimensions of the sheet 12, printed indicia such as a birthday or vacation greeting on the rear surface 33, and a coating 36 of a release material over the front surface 32 affording firm adhesion of the layer 20 of adhesive on the sheet 12 around the photograph 11 along the front surface 32 of the greeting card 30 to thereby support the photograph 11 and cover assembly 10 along the front surface 32, while affording removal of the layer 20 of adhesive form the front surface 32 of the greeting card 30 without damage thereto. Preferably the release material in the coating 36 consists of a mixture by weight of 30 parts of PS-849 pendant functional mercaptopolydiorganosiloxane of 100–200 centistokes viscosity (available from Huls America Inc.), 100 parts of methyl acrylate, 75 parts of acrylic acid, 307.5 parts of methylethyl ketone, and 0.5 parts of 2,2'-azobisisobutyronitrile (AIBN), which mixture is reacted by being mixed for 16 hours at a constant temperature of 55 degrees Centigrade.

The cover assembly 10 according to the present invention has now been described with reference to one embodiment thereof used alone or in combination with the greeting card 30. It will be apparent to those skilled in the art that many changes can be made in the embodiment of the cover assembly 10 described, and that the cover assembly 10 could be used in other combinations without departing from the scope of the present invention. Thus the scope of the present invention should not be limited to the structure described in this application, but only by structures described by the language of the claims and the equivalents of those structures.

I claim:

1. A photograph cover assembly for use on photographs in a range of sizes, said cover assembly comprising:

a flexible conformable generally planar polymeric sheet having a thickness of up to about 0.2 millimeter, opposite front and rear major surfaces, a peripheral edge between said major surfaces having length and width dimensions exceeding the length and width dimensions of photographs in said range of sizes by at least 6 millimeters, a generally centrally located viewing portion that is visually transparent between said surfaces, and a frame portion around said viewing portion, said viewing portion having a size and shape adapted to afford viewing of a central portion of a photograph in said range of sizes with edge portions of the photograph around said central portion extending along said frame portion; and a layer of repositionable pressure sensitive adhesive along said frame portion on the rear surface of said polymeric sheet with the viewing portion of said polymeric sheet being free of adhesive, said layer of repositionable pressure sensitive adhesive being firmly adhearable to the edge portion of the photograph and to a smooth firm surface of a substrate on the side of the photograph opposite the polymeric sheet to conform said polymeric sheet to the edge portions of the photograph extending along said frame portion, hold the photograph against the polymeric sheet, and support the photograph and polymeric sheet along the surface of the substrate, while the layer of repositionable pressure sensitive adhesive on the polymeric sheet is removable from the surface of the substrate and edge portions of the photograph extending along said frame portion without damage thereto.

2. A cover assembly according to claim 1 wherein said layer of repositionable pressure sensitive adhesive is a mixture of a permanent isooctyl acrylate/acrylic acid copolymer pressure sensitive adhesive and a repositionable pressure sensitive adhesive comprising inherently tacky elastomeric acrylate microspheres which are solid in nature, comprises from 5 to 20 percent of the permanent pressure sensitive adhesive and from 95 to 80 percent of the repositionable pressure sensitive adhesive, and is applied in a layer weighing in the range of 8.37 to 16.7 grams per square meter.

3. A cover assembly according to claim 2 wherein said mixture comprises about 15 percent of the permanent pressure sensitive adhesive, about 85 percent of the repositionable pressure sensitive adhesive, and is applied in a layer weighing about 12.6 grams per square meter.

4. A cover assembly according to claim 1 including means for making opaque at least a major part of the frame portion of the polymeric sheet.

5. A cover assembly according to claim wherein said means for making opaque at least a major part of the frame portion of the polymeric sheet is an opaque layer on one surface of said polymeric sheet.

6. A cover assembly according to claim wherein said means for making opaque at least a major part of the frame portion of the polymeric sheet is an opaque material incorporated in the frame portion of said polymeric sheet.

7. A cover assembly according to claim 1 wherein the material of said polymeric sheet is polyester and said polymeric sheet is in the range of about 0.0127 to 0.051 millimeter thick.

8. In combination, a cover assembly for use on photographs in a range of sizes, said cover assembly comprising:

a flexible conformable generally planar polymeric sheet having a thickness of up to about 0.2 millimeter, opposite front and rear major surfaces, a peripheral edge between said major surfaces having length and width dimensions exceeding the length and width dimensions of photographs in said range of sizes by at least 6 millimeters, a generally centrally located viewing portion that is visually transparent between said surfaces, and a frame portion around said viewing portion, said viewing portion having a size and shape adapted to afford viewing of a central portion of a photograph in said range of sizes with edge portions of the photograph around said central portion extending along said frame portion; and a layer of repositionable pressure sensitive adhesive along said frame portion on the rear surface of said polymeric sheet with the viewing portion of said polymeric sheet being free of adhesive; and a greeting card having opposite front and rear major surfaces, a peripheral edge between said major surfaces having length and width dimensions about the same as the length and width dimensions of said polymeric sheet, printed indicia on said rear surface, and a coating of release material on said front surface;

said layer of repositionable pressure sensitive adhesive being firmly adhearable to the edge portion of the photograph and to the front surface of said greeting card around the photograph to conform said polymeric sheet to the edge portions of the photograph extending along said frame portion, hold the photograph against the polymeric sheet, and support the photograph and polymeric sheet along the front surface of the greeting card, while the layer of repositionable pressure sensitive adhesive on the polymeric sheet is removable from the front surface of the greeting card and edge portions of the photograph extending along said frame portion without damage thereto.

9. A combination according to claim 8 wherein said layer of repositionable pressure sensitive adhesive is a mixture of a permanent isooctyl acrylate/acrylic acid copolymer pressure sensitive adhesive and a repositionable pressure sensitive adhesive comprising inherently tacky elastomeric acrylate microspheres which are solid in nature, comprises from 5 to 20 percent of the permanent pressure sensitive adhesive and from 95 to 80 percent of the repositionable pressure sensitive adhesive, and is applied in a layer weighing in the range of 8.37 to 16.7 grams per square meter.

10. A combination according to claim 9 wherein said mixture comprises about 15 percent of the permanent pressure sensitive adhesive, about 85 percent of the repositionable pressure sensitive adhesive, and is applied in a layer weighing about 12.56 grams per square meter.

11. A combination according to claim 8 including means for making opaque at least a major part of the frame portion of the polymeric sheet.

12. A combination according to claim 11 wherein said means for making opaque at least a major part of the frame portion of the polymeric sheet is an opaque layer on one surface of said polymeric sheet.

13. A cover assembly according to claim 11 wherein said means for making opaque at least a major part of the frame portion of the polymeric sheet is an opaque material incorporated in the frame portion of said polymeric sheet.

14. A cover assembly according to claim 8 wherein the material of said polymeric sheet is polyester and said polymeric sheet is in the range of about 0.0127 to 0.051 millimeter thick.

* * * * *